US006237170B1

(12) United States Patent
Salens

(10) Patent No.: US 6,237,170 B1
(45) Date of Patent: May 29, 2001

(54) ADJUSTABLE SLAT MOUNTING DEVICE

(75) Inventor: Luc Salens, Maldegem (BE)

(73) Assignee: LS Bedding, Bruges (BE)

( * ) Notice: Subject to any disclaimer, the term of this patent is extended or adjusted under 35 U.S.C. 154(b) by 0 days.

(21) Appl. No.: 09/511,074

(22) Filed: Feb. 23, 2000

(51) Int. Cl.[7] ..... A47C 23/06
(52) U.S. Cl. ..... 5/236.1; 5/238; 5/241
(58) Field of Search ..... 5/191, 236.1, 237, 5/238, 239, 241, 244

(56) References Cited

U.S. PATENT DOCUMENTS

| | | | | |
|---|---|---|---|---|
| 4,136,411 | * | 1/1979 | Fanti | 5/238 |
| 4,752,981 | * | 6/1988 | Salens | 5/238 |
| 5,774,911 | * | 7/1998 | Stube et al. | 5/238 |

FOREIGN PATENT DOCUMENTS

| | | | | |
|---|---|---|---|---|
| 903 459 | | 2/1986 | (BE) . | |
| 88 07 696 | | 10/1989 | (DE) . | |
| 273 438 | | 7/1988 | (EP) . | |
| 512 569 | | 11/1992 | (EP) . | |
| 852 124 | | 7/1998 | (EP) . | |
| 2689742-A1 | * | 10/1993 | (FR) | 5/238 |

* cited by examiner

*Primary Examiner*—Michael F. Trettel
(74) *Attorney, Agent, or Firm*—Pillsbury Winthrop LLP

(57) ABSTRACT

A device for attaching a slat of a slatted base to the edge of a slatted base, the device including a first member (6, 8) to be attached inside an edge of the slatted base, recesses and grooves (9, 11) to detachably connect the first member with a second member (1, 5) for receiving at least one slat, wherein the second member (1, 5) includes a flexible bent arm (1) with an upper and a lower end (2,3,) that are connected to each other by a middle-piece (4), the upper end (2) of the arm being connected to an end-piece (5) with at least one opening (5') for receiving the end of at least one slat of the slatted base and for extending beyond the edge of the slatted base, co-operating recesses and protrusions (7, 9, 10, 11) for adjusting the height of the slat.

9 Claims, 3 Drawing Sheets

ADJUSTABLE SLAT MOUNTING DEVICE

BACKGROUND OF THE INVENTION

1. Field of the Invention

This invention relates to a device for attaching the slats in a slatted base.

2. Description of the Related Art

From EP-A-0.852.124 a device is known which solves the problem of providing a slatted base in which the slats are attached in such a way that upon exerting a force the bending of the slat remains substantially constant independent of the position where the force is exerted, and in which the slats are able to optimally adapt themselves to the anatomy of the body without an individual adjustment of each separate slat being necessary. To this purpose the device described in EP-A-0.852.124 comprises a bent, springy arm for connecting a first member which is attached to the edge of the slatted base with a second member for receiving the end of a slat which extends in transverse direction of the slatted base. The spring is slideably mounted in the first or second member, and is slideable in the direction of the outside of the edge of the slatted base. The slat is bent in an upward direction.

The device described in EP-A-0.852.124 however has the disadvantage in that a pressure which is exerted on the slat from above not only causes a bending of the slat in vertical direction, but also a displacement of the slat in longitudinal direction of the slatted base, due to torsion of the spring. This has the consequence that the supporting of the body in longitudinal direction of the slatted base is unstable.

The slatted base described in BE-A-903.459 is able to adapt itself to the shape of the body, because means are provided for adjusting the height of the slats in the slatted base. These means comprise a rubber end-piece with a first opening for receiving a slat. The rubber end-piece contains at least two further openings and co-operates with a carrier which is provided to be attached to the inside of the edge of the slatted base. The carrier contains at least one pin which is provided to be received in one of the at least two further openings of the end-piece. Because the carrier is mounted on the inside of the edge of the slatted base, the height of the slat cannot be adjusted without using tools.

SUMMARY OF THE INVENTION

The purpose of the present invention consists in providing a device which permits adjusting the height of the slats of a slatted base, in which a displacement of the slats in longitudinal direction of the slatted base is counteracted.

This is achieved according to the invention with the characteristics described in the characterising part of the first claim.

The connection of the upper and a lower end of the flexible bent arm by means of a middle-piece prevents that a torsion of the lower part in relation to the upper part can occur. By this a displacement of the slat in longitudinal direction of the slatted base is counteracted, so that a stable supporting of the body in longitudinal direction of the slatted base can be ensured.

The lying comfort in the case of two or more slatted bases mounted next to each other is improved because the opening for receiving the end of a slat extends beyond the edge of the slatted base. In a bed in which two separate slatted bases are mounted next to each other there is namely mostly a free space between the two slatted bases in which the body is not supported. Because the ends of the slats extend beyond the edge of the slatted base it is possible to limit this space to a minimum.

Other details and advantages of the invention will appear from the following description and figures.

DETAILED DESCRIPTION OF THE PREFERRED EMBODIMENTS

Figure 1:
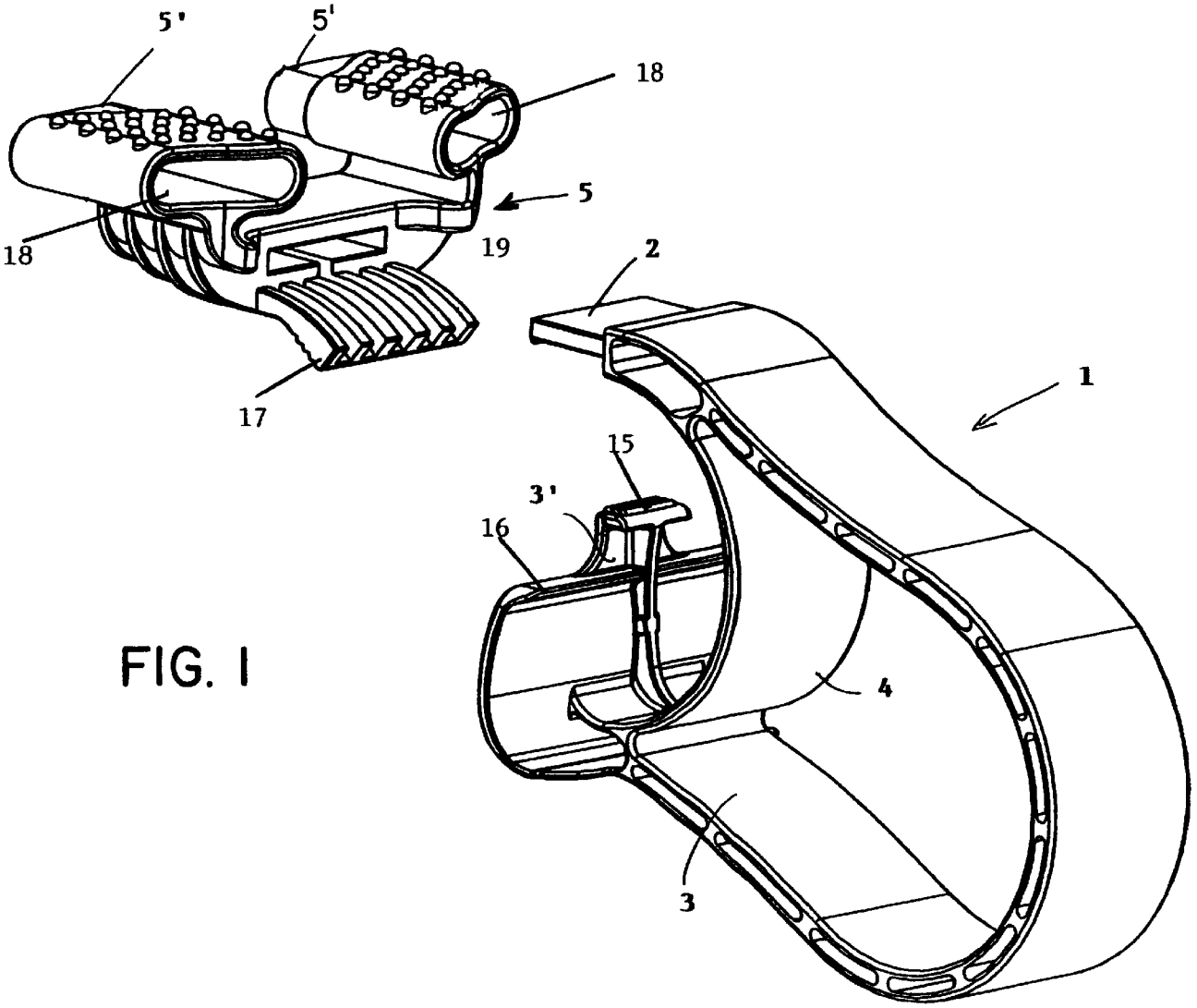
In FIGS. 1 and 2 the curved arm and an end-piece for receiving a slat of the device of the invention are shown in perspective.
Figure 2:
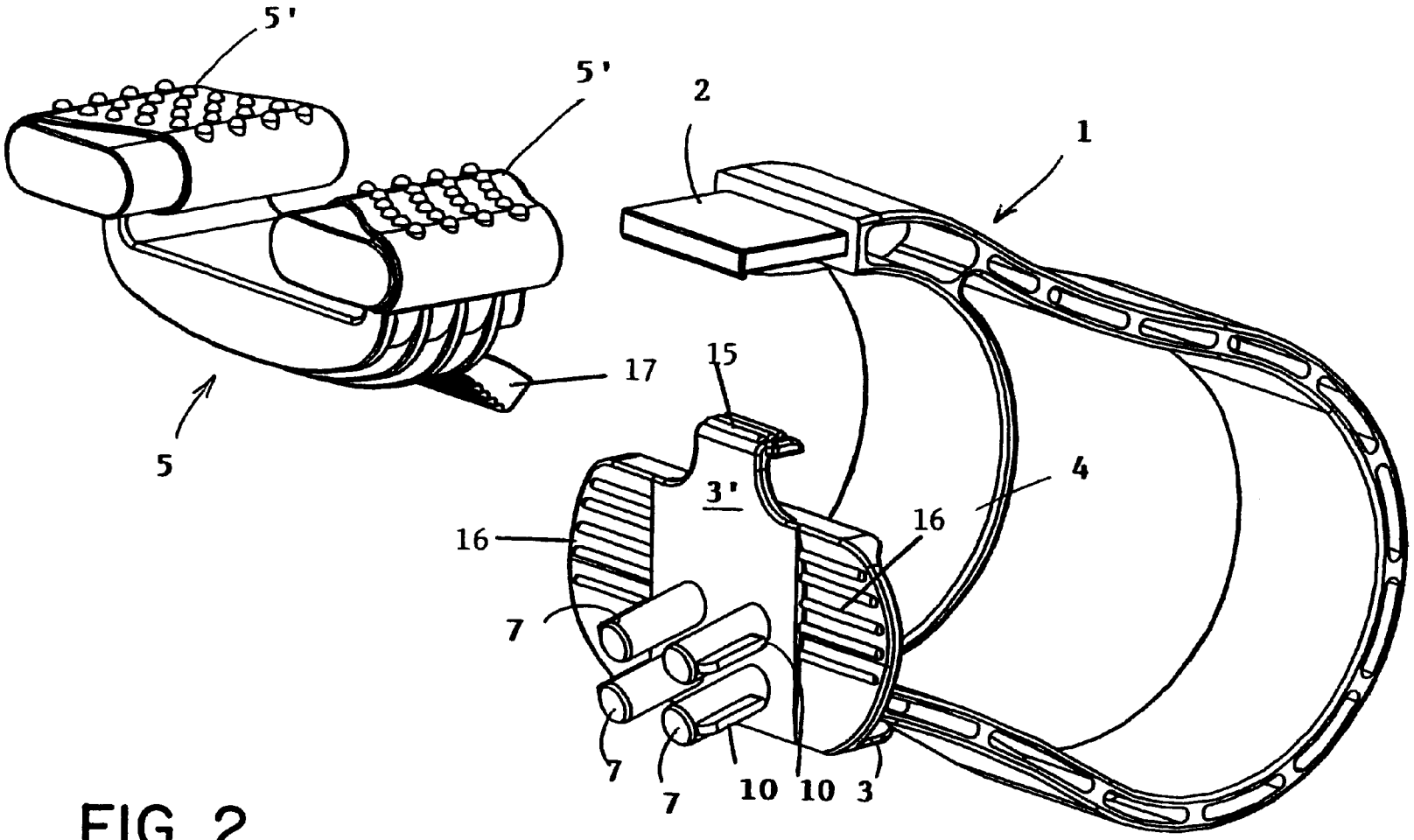
Figure 3:
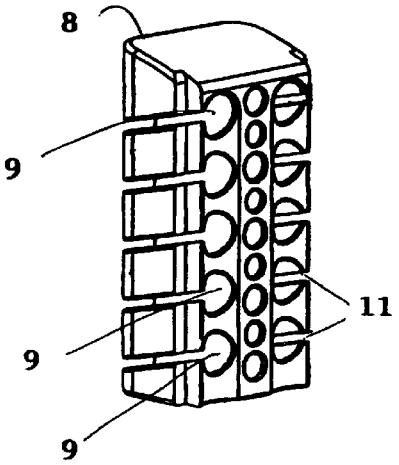
FIGS. 3 and 4 show in perspective a rubber block for receiving the curved arm.
Figure 4:
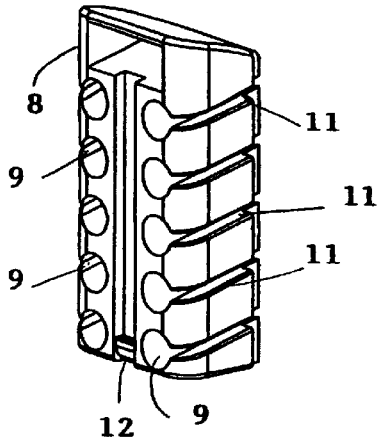
Figure 5:
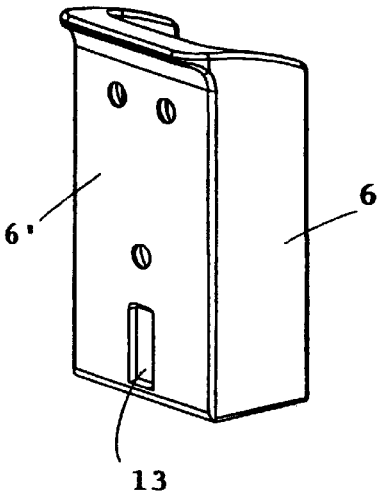
In FIGS. 5 and 6 the housing for the block is shown.
Figure 6:
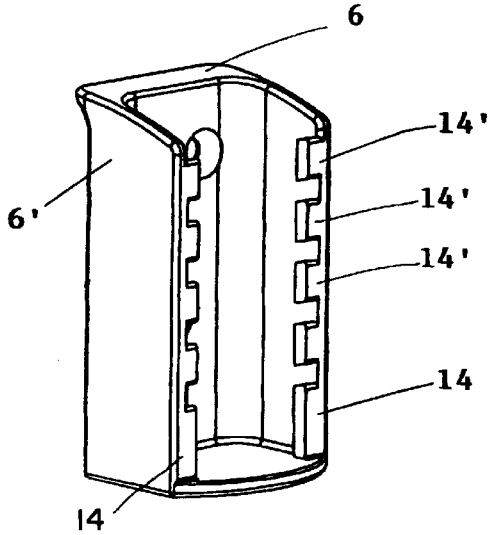

The device shown in FIGS. 1 and 2 comprises a first member 6, 8 which is provided to be attached inside an edge of the slatted base and a second member 1, 5 for connecting at least one slat of the slatted base with the first member 6, 8. The first member 6, 8 and the second member 1, 5 are detachably connectable. To this end means 7, 9, 10, 11 are provided.

The first member 6, 8 preferably comprises a housing 6 for attachment to the inside of the edge of the slatted base. A rubber block 8 fits in the housing 6, in which block a plurality of recesses 9 are provided which are translated in relation to each other in vertical direction of the block. The housing 6 preferably has the form of a parallelepiped. The recesses 9 preferably have the form of passages 9. Each passage 9 has a side in connection with a groove 11, which extends in transverse direction of the block 8. In the embodiment shown in the figures four pairs of passages are provided in the rubber block 8. In a preferred embodiment the passages 9 slant in the direction of the bottom of the bed frame, preferably in an angle of about 10° (the term "below" refers to the angle in which these parts are arranged in the state of use).

The second member comprises a flexible bent arm 1 with an upper and a lower end 2, 3 which are connected to each other by means of a middle-piece 4. Upon exertion of a force on the middle-piece 4 the bending of the middle-piece increases. The connection makes sure that a force exerted on the piece is transformed into a compression of the arm 1 in vertical direction of the arm and that a torsion of the upper and the lower end 2, 3 in relation to each other is counteracted in the process. The middle-piece 4 is preferably fixedly connected to the arm 1.

The upper end 2 of the arm 1 contains an extension for connecting the arm to an end-piece 5 for receiving at least one slat of the slatted base. The end-piece 5 is preferably a carrying rubber made in a soft, flexible material. The carrying rubber 5 contains at least one holder 5' with an opening 18 for receiving a slat. The carrying rubber 5 also contains an opening 19 for receiving the extension 2. The holder 5' is extended in such a way that an end extends at least beyond the edge of the slatted base. This mainly has an advantage in case two slatted bases are positioned next to each other. In that case it is possible to ensure that the open space between slats of adjoining slatted bases is limited to a minimum, or that possibly an overlap of the slats of adjoining slatted bases is present. In the device of this invention carrying rubber known to the person skilled in the art can be used.

The second member preferably contains a brake 15 for limiting the extent to which the bent arm 1 can be compressed and the middle-piece can be bent. This brake 15 is connected to the lower end of the arm 1 and is provided to limit the downward movement of the upper end of the arm 1. Below, the end-piece 5 is preferably provided with an additional protrusion 17 which is made in a soft, flexible material. Upon maximal compression of the arm 1, by exerting a downward force on top of the arm 1 via a slat, the end-piece 5 is displaced in the direction of the brake 15 until the additional protrusion 17 of the end-piece 5 contacts the brake 15. Because the additional protrusion 17 is constructed in a flexible, soft material it is possible to prevent the production of unwanted noise in the contact of the end-piece 5 with the brake 15.

The means for detachably connecting the first and second members comprise protrusions 7 on the lower end 3 of the arm 1 which are vertically translated in relation to each other. The protrusions 7 are provided to be received in the passages 9 in the rubber block 8 of the first member.

The protrusions 7 preferably have the form of centering pins. In a preferred embodiment the passages 9 and the centering pins 7 slant downwards in relation to the bed frame, preferably in an angle of about 10° . By this slanted device it is possible to prevent that the arm 1 too easily comes loose from the block 8 and that the pressure of the weight of the user of the slatted base can be used to tighten the connection between the first member and the second member. Positioning the centering-pins 7 horizontally namely entails a risk that the arm comes loose from the block 8 by itself. The centering pins 7 are preferably provided with an additional protrusion or vane 10. The vanes 10 are provided to co-operate with and to be received in corresponding grooves 11 in the rubber block 8, which extend sideways and adjacent the passages 9. These provisions create a reliable connection between the parts which are directly connected with the bed frame.

The lower end 3 of the arm is preferably extended 16 in longitudinal direction of the slatted base, with a first and second lip 16. These lips form the points of action with which the height of the arm 1 can be adjusted.

In the embodiment shown in FIG. 2 two pairs of centering pins 7 are provided on the lower end 3 of the flexible arm 1. By means of these the flexible arm 1 can be positioned at four heights in relation to the rubber block 8. Thus, the height of each slat in relation to the bed frame is adjustable. This means that the sleeping surface over the entire length of the slatted base can be adjusted to the body of the user.

In the housing 6 and the block 8 preferably complementary, co-operating means 12, 13 are provided to limit the moveability of the block in the housing. In a preferred embodiment these means comprise a shock pin 12 which is provided at the bottom of the rubber block 8 and which fits in a groove 13 in the lower part of the side 6' of the housing 6. This permits a limited longitudinal displacement of the rubber block 8 in the housing 6. On the side which points towards the centering pins, the housing 6 further shows two toothed edges 14 in vertical direction of the housing, the edges opposing each other. It should be noted that pressing the centering pins 7 into the rubber block 8, or removing the centering pins 7 from it, can only occur for a position of the rubber block 8 in relation to the housing 6 in which the vanes 10 can slide between the teeth 14' of the toothed edges 14 of the housing 6. This construction leads to the fact that, when the rubber block 8 is positioned in the normal position in use at the bottom of the housing 6, the vanes 10 of the centring pins 7 become blocked behind the toothed edges 14 of the housing 6. Because of this, at the same time the flexible arm 1 becomes blocked.

Figure 7:
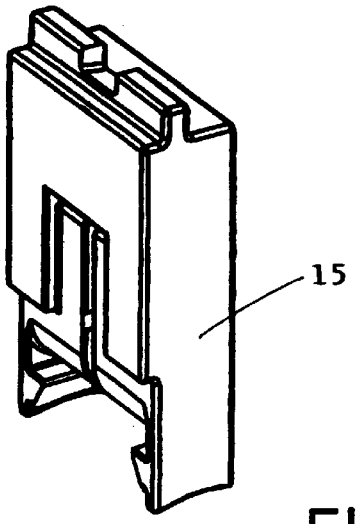
FIG. 7 shows a blocking block in perspective.

If the springy characteristics of a flexible arm 1 are to be neutralized, use can be made of a blocking block 15 (FIG. 7) which has to be placed between the upper end 2 and the lower end 3 of the flexible arm 1.

By means of the above described device a slat can be moved in vertical direction of the slatted base as follows. By engaging the extensions 16 at the lower end 3' of the flexible arm 1, and moving the plane 3' on which the centring pins are located in the direction of the arm 1, the centering pins 7 can be removed from the passages 9 in which they are located. Subsequently the centering pins 7 can be brought into other passages 9, which are located above or below the original passages 9.

From the description of the device given above, according to the invention, appears that two main problems which occur upon using a slatted base are solved here, namely adjusting the height of the bendable slats and bridging the space which normally occurs between two slatted bases mounted next to each other in a springy way.

What is claimed is:

1. Device for attaching a slat of a slatted base to an edge of a slatted base, which device comprises a first member (6, 8) which is provided to be attached inside of the edge of the slatted base, means (9, 11) being provided on the first member to detachably connect it with a second member (1, 5) for receiving at least one slat, characterized in that the second member (1, 5) comprises a flexible bent arm (1) with an upper and a lower end (2, 3) which are connected to each other by means of a middle-piece (4), the upper end (2) of the arm being connected to an end-piece (5) with at least one opening (5') for receiving the end of at least one slat of the slatted base and the at least one opening (5') of the end-piece extending beyond the edge of the slatted base, co-operating recesses and protrusions (7, 9, 10, 11) for adjusting a height of the slat being provided on the lower end (3) of the arm (1) and on the first member (6, 8) in vertical direction of the edge.

2. Device according to claim 1, characterized in that the co-operating recesses and protrusions (7, 9, 10, 11) comprise at least one pin (7) provided on the lower end (3) of the arm and at least two passages (9, 11) in the first member (6, 8) for receiving the at least one pin (7) which are translated in vertical direction in relation to each other, and that the at least one pin (7) and the at least two passages (9, 11) slant in the direction of the bottom of the arm (1).

3. Device according to claim 2, characterized in that the at least one pin (7) is provided with a vane (10) and that the passages (9) are each provided with a groove (11), which groove (11) is provided to receive the vane (10).

4. Device according to claim 2, characterized in that the first member (6, 8) comprises a housing (6) with a block (8) made from a flexible material, the passages (9) being provided in the block (8).

5. Device according to claim 2, characterized in that complementary, co-operating means (12, 13) are provided in the first member (6,8).

6. Device according to claim 4, characterized in that on a side pointing towards the centering pins (7), the housing (6) shows two toothed edges (14) opposing each other, a distance between edges and a height of teeth (14') being such that when the rubber block (8) is fully compressed vanes (10) of the centering pins (7) are located behind the toothed edges (14).

7. Device according to claim 1, characterised in that the device comprises a blocking block (20) for blocking movement of the upper end (2) in relation to the lower end (3) of the arm (1).

8. Device according to claim 1, characterised in that a brake (15) is provided on the lower end (3) of the arm (1) for limiting downward movement of the upper end of the arm (2) in relation to the lower part.

9. Device according to claim 8, characterised in that an additional protrusion (17) is provided at a bottom of the end-piece (5), which additional protrusion is made in a flexible material and which contacts the brake (15) upon maximal compression of the arm.

* * * * *